United States Patent [19]

Karwat et al.

[11] 4,250,150

[45] Feb. 10, 1981

[54] PROCESS FOR THE TREATMENT OF GASEOUS MIXTURES, WHICH CONTAIN SOUR GASES, WITH ORGANIC SOLVENTS

[75] Inventors: Heinz Karwat, Pullach; Roland Lang, Wolfratshausen; Wolfgang Jelend, Munich, all of Fed. Rep. of Germany

[73] Assignee: Linde Aktiengesellschaft, Wiesbaden, Fed. Rep. of Germany

[21] Appl. No.: 213

[22] Filed: Jan. 2, 1979

[30] Foreign Application Priority Data

Dec. 30, 1977 [DE] Fed. Rep. of Germany ..... 2759123
Dec. 30, 1977 [DE] Fed. Rep. of Germany ..... 2759124

[51] Int. Cl.[3] ..... B01D 53/34

[52] U.S. Cl. ..... 423/226; 423/246; 423/659; 55/68; 55/73

[58] Field of Search ..... 423/226, 228, 229, 246, 423/DIG. 80, 659; 55/68, 73; 252/189, 191, 192, 387, 389, 392, 396

[56] References Cited

U.S. PATENT DOCUMENTS

| | | | |
|---|---|---|---|
| 1,613,808 | 1/1927 | Schreiber | 252/387 |
| 1,797,402 | 3/1931 | Calcott et al. | 252/389 R |
| 1,927,842 | 9/1933 | McDermott | 252/387 |
| 2,718,454 | 9/1955 | Wylie | 252/192 X |
| 2,764,553 | 9/1965 | Hartford | 252/387 |
| 3,453,835 | 7/1969 | Hochgesand | 55/68 |
| 3,653,810 | 4/1972 | Bratzler et al. | 423/229 |
| 3,864,449 | 2/1975 | Homberg et al. | 423/229 |
| 4,137,294 | 1/1979 | Bratzler et al. | 423/228 X |

OTHER PUBLICATIONS

"Corrosion Inhibitor Checklist", Chemical Engineering, Dec. 1954, pp. 230, 232 & 234.

*Primary Examiner*—Earl C. Thomas
*Attorney, Agent, or Firm*—Millen & White

[57] ABSTRACT

Process for the treatment of gaseous mixtures, which contain sour gases, with organic solvents, characterized in that the treatment is conducted in the presence of alkaline-reacting compounds in order to prevent corrosion of apparatus parts made of iron or steel.

11 Claims, 2 Drawing Figures

PROCESS FOR THE TREATMENT OF GASEOUS MIXTURES, WHICH CONTAIN SOUR GASES, WITH ORGANIC SOLVENTS

The invention relates to a process for the treatment of gaseous mixtures containing sour gases with organic solvents.

Crude gases stemming from the combustion of carbonaceous fuels and containing primarily hydrogen and carbon oxides, as well as hydrogen sulfide are subjected to such a treatment, for example. Thus, customarily the hydrogen sulfide is first scrubbed out with methanol from crude gases intended for the methanol synthesis, and the thus-pretreated crude gas is then divided into two partial streams, of which one is fed directly to the methanol synthesis and the other is fed to the latter only after converting carbon monoxide to carbon dioxide and after scrubbing out the carbon dioxide with methanol for the purpose of setting the the hydrogen-carbon oxide ratio appropriate for the synthesis. During the course of the process, strong corrosion occurs, especially in heat exchangers in the gas passage of the bipartite methanol scrubbing stage; heretofore, this corrosion has been counteracted by manufacturing the affected parts of the apparatus from expensive, highalloy fine steels (see, in this connection, for example, "Erdoel and Kohle - Erdgas - Petrochemie vereinigt mit Brennstoff-Chemi" [Petroleum and Coal—Natural Gas - Petrochemistry Combined with Fuel Chemistry] 29 [2] February 1976:61–63).

The aforementioned corrosion phenomena occur in the same way in the production of pure hydrogen from crude hydrogen containing sour gases, especially carbon oxides and hydrogen sulfide, wherein it is likewise customary to scrub out the hydrogen sulfide, as well as the carbon dioxide enriched therein due to catalytic carbon monoxide conversion, with the aid of methanol.

It is presumed that the aforementioned corrosion manifestations are due, in part, to the formation of iron carbonyls, especially iron pentacarbonyl, as well as sulfurcontaining iron carbonyls. The latter represent more or less stable intermediates in the formation of iron pentacarbonyl. The presence of sulfur in the form of hydrogen sulfide apparently promotes the reaction of carbon monoxide with the metallic iron (see, for example, "Ullmann's Enzyklopaedie der technischen Chemie" [Ullmann's Encyclopedia of Technical Chemistry] 6 [1955]: 409, as well as 12 [1960]:315). The formation of these carbonyls is disadvantageous not only because of the directly occurring damage to the affected parts of the apparatus, but also due to the decomposition products of the carbonyls which are present in the thermal regeneration of the loaded scrubbing methanol. The decomposition products precipitated as solid matter, namely elemental sulfur, as well as iron sulfides, lead to obstructions in the pipelines and apparatus of the methanol scrubbing stage.

Similar effects are found in the drying of gaseous mixtures containing sour gases, especially hydrogen sulfide and carbon oxides, by washing with glycols. Here again, deposits of solid decomposition products of carbonyls occur during the thermal regeneration of the loaded organic scrubbing medium.

The above-described corrosion manifestations occurring at apparatus parts of iron and/or normal steels necessitate perforce the replacement of these parts made of the apparatus by parts made of high-alloy, corrosion-resistant steels, unless frequently recurring interruptions in the operation can be tolerated for cleaning and repair purposes. This, however, leads to a considerable increase in the initial investment costs.

It is, therefore, an object of the present invention to lower the initial investment costs in a process of the type described in the foregoing to a minimum, especially with regard to the expenses incurred for the use of corrosion-resistant steels for corrosion-endangered parts of the apparatus.

This object has been attained by providing that the treatment is conducted in the presence of alkaline-reacting compounds, in order to prevent the corrosion of apparatus parts made of iron or steel. Suitable as such alkaline-reacting compounds are, for example, alkaline solutions, ammonia, or amines. It has been found that, by means of these additives, corrosion can be entirely suppressed or reduced to a negligible extent. It is thereby made possible to replace the heretofore employed apparatus parts made of high-alloy fine steels by those made of normal steel and thereby to attain considerable savings in initial investment costs without impairing thereby the flawless operation of the process or of the plant. The corrosion-inhibiting effect of the added compounds in the present context is surprising insofar as it has been known (see "Zeitschrift fuer angewandte Chemie" [Periodical of Applied Chemistry] 41st Year [1928] 30:830) that ammonia in minor quantities promotes the formation of iron pentacarbonyl.

To execute the procedure according to this invention, the provision is made, on the one hand, to add the alkalinereacting compounds to the organic solvent, wherein the concentration of the alkaline-reacting compounds in the organic solvent is maintained at values of between 5 and 200 millimoles per liter, preferably between 30 and 60 mmol/1. On the other hand, there is the possibility of adding the alkaline-reacting compounds in gaseous form to the gaseous mixture even prior to the treatment. This possibility is utilized, above all, when adding ammonia as the alkaline-reacting compound, since ammonia has a relatively low boiling point.

The procedure of this invention is applicable with special advantage to processes for the removal of hydrogen sulfide and optionally carbon dioxide from a gaseous mixture, which latter furthermore contains carbon monoxide, by scrubbing with methanol, wherein the alkaline-reacting compounds are added to the methanol.

The crude gases introduced into such a treatment frequently still contain a certain percentage of water. Since methanol washing steps are preferably conducted at below 0° C. and liquid methanol is admixed to the gaseous mixture to be treated prior to or during the cooling step down to the washing temperature, which step precedes the washing process, this being done to avoid clogging by ice formation, it is advantageous to add the corrosion-preventing, alkaline-reacting compounds already to this methanol. In case of a cycle-type scrubbing step consisting of a washing step and a subsequent regeneration of the scrubbing medium it is expedient to add ammonia as the alkaline-reacting compound, since this compound circulates within the cycle at a minimum of losses.

When utilizing the process of this invention for the drying of gaseous mixtures, which contain sour gases, especially hydrogen sulfide and carbon monoxide, by scrubbing with alcohols, especially glycols, the alkaline-reacting compounds are added to the alcohols.

DETAILED DESCRIPTION OF THE DRAWINGS

Figure 1:
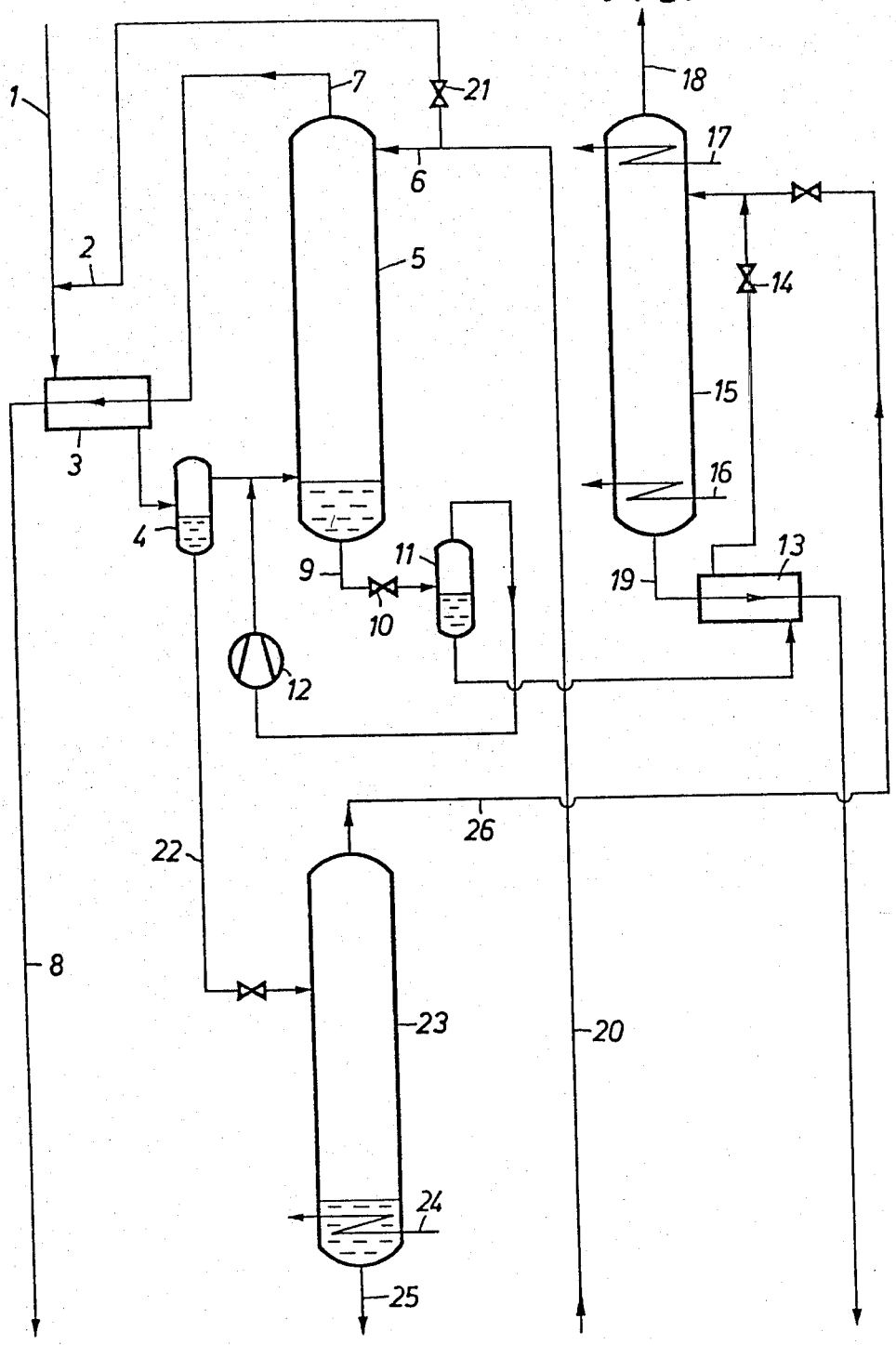
FIG. 1 is a schematic illustration of a preferred embodiment of the invention wherein the raw feed gas contains hydrogen sulfide, carbonyl sulfide, and is rich in carbon monoxide.

FIG. 1 shows schematically a process serving, with the use of the procedure according to this invention, for the removal of hydrogen sulfide and carbonyl sulfide, as well as carbon dioxide from a gas rich in carbon monoxide.

The gaseous mixture, introduced into the process at 1, contains as the primary components about 57 mol percent carbon monoxide, about 28 mol percent hydrogen, and about 13 mol percent carbon dioxide. In addition, the gaseous mixture comprises as impurities about 0.7 mol percent hydrogen sulfide and about 0.1 mol percent carbonyl sulfide, as well as steam and minor amounts of readily volatile components. However, the carbon monoxide contents can also vary within wide ranges, i.e. between about 5 and 90 mol percent. The pressures range preferably between 5 and 80 bar.

After the addition of liquid methanol via a conduit 2, the gaseous mixture is cooled in a heat exchanger 3. The addition of methanol serves for preventing the ice formation in heat exchanger 3. The water dissolved in methanol is subsequently separated in a separator 4 together with the methanol in the form of a liquid phase. The gaseous mixture, thus freed of the water, is introduced into the scrubbing column 5 where it is freed of hydrogen sulfide and carbonyl sulfide countercurrently to liquid methanol introduced via a conduit 6. From the head of the scrubbing column 5 a gaseous mixture free of hydrogen sulfide and carbonyl sulfide is withdrawn via conduit 7; after being reheated in heat exchanger 3, this gaseous mixture is passed on via conduit 8 to a conversion plant and subsequently to another scrubbing column, not shown, for the purpose of removing carbon dioxide therefrom.

The liquid scrubbing methanol, loaded with hydrogen sulfide and carbonyl sulfide, as well as any dissolved carbon dioxide, is discharged via a conduit 9 from the sump of the scrubbing column 5 and fed, after expansion in an expansion valve 10, to a separator 11 where the readily volatile components, degassed during expansion, are separated. These components are withdrawn from the head of the separator and, after compression in a compressor 12, returned into the gaseous mixture to be fed to the scrubbing column 5. The loaded scrubbing methanol discharged from the sump of separator 11 is introduced, after being heated in a heat exchanger 13 and further expanded in an expansion valve 14, into a regenerating column 15. In the latter the absorbed gaseous components, namely hydrogen sulfide, carbonyl sulfide, as well as optionally carbon dioxide, are driven out by means of the sump heating unit 16 and withdrawn from the head of the column via a conduit 18. In a head condenser 17, evaporated methanol is retained.

The completely regenerated scrubbing methanol is withdrawn from the sump of column 15 via a conduit 19 and, after cooling in heat exchanger 13, fed to the above-mentioned scrubbing column, not shown, for removing carbon oxide. The carbon dioxide thus absorbed by the scrubbing methanol is driven off to the largest part in a stripping column, likewise not shown. The scrubbing methanol which thereafter still contains a small amount of carbon dioxide, but is free of hydrogen sulfide and carbonyl sulfide, is recycled into the scrubbing column 5 via conduits 20 and 6, respectively.

With the aid of a control valve 21, a minor proportion of this slightly carbon-dioxide-containing scrubbing methanol is branched off and fed via conduit 2 into the gaseous mixture to be treated. The water-containing methanol separated in the liquid phase in separator 4 is fed via a conduit 22 to a water-methanol separating column 23 where the methanol is driven off in the gaseous phase with the aid of a sump heating unit 24. From the sump of this separating column, water is discharged via a conduit 25, and gaseous methanol is withdrawn from the head via a conduit 26. This methanol is introduced into the regenerating column 15.

If no special corrosion-inhibiting measures are taken, corrosion occurs already to a considerable extent in heat exchanger 3 if normal steel is employed. The thus-formed corrosion products are carried into the water-methanol separating column 23 and decomposed therein by the effect of heat. The solid decomposition products are deposited in the separating column as well as in the heat exchanger serving as the sump heating unit 24 and lead already after a brief period of time to considerable impairment of operation. Corrosion is likewise unavoidable in the scrubbing column 5 if normal steel is utilized. The corrosion products are carried into the regenerating column 15 and likewise decomposed therein under the effect of heat. Here again, the solid decomposition products are deposited in the lower portion of the column, in the heat exchanger serving as the sump heating unit 16, and also in the subsequently connected heat exchanger 13.

The aforedescribed corrosion phenomena, which impair the operation as well as the lifetime of the plant or which necessitate the use of expensive high-alloy, high-quality steels, can be prevented with the aid of the measure according to this invention. The alkaline-reacting compounds to be added can be introduced, in principle, at any desired point of the methanol cycle. The corrosion inhibitors, due to their high solubility in methanol, remain almost completely in the liquid scrubbing medium phase. The use of ammonia is found to be especially advantageous inasmuch as the ammonia passes over at least partially into the vapor phase initially within the regenerating column 15, on the one hand, but is retained at that point by the head condenser 17, and can be readily withdrawn, together with the methanol, in the gaseous phase from the head of the column in the water-methanol separating column 23, on the other hand. The cycle losses are thus especially low when using ammonia. Amines are even more readily retained in the liquid methanol phase, but are separated in the water-methanol separating column 23 together with the liquid sump product. The thuscaused losses, though, are minor since the amount of methanol fed via conduit 2 and to be regenerated in the separating column 2 constitutes only a small percentage of the cycle methanol.

Apart from the strongly corrosion-inhibiting effect of the steps of this invention, as demonstrated when used in largescale technical processes of the aforedescribed type, this effect can already be impressively confirmed on a laboratory scale:

For example, if a gaseous mixture consisting of 99.2 vol-% carbon monoxide and 0.8 vol-% hydrogen sulfide is conducted at a temperature of 30° C. in a total amount of 20 N1. for a period of two hours through 20 ml. of a liquid volume consisting of 90% methanol and 10% water, then the corrosive action on iron or steel pins located in the liquid volume is highly different: The quantity of dissolved iron with the use of high-quality steel pins (10 XCrNiTi 18/9) is less than 0.02 mg., whereas this value when using plain iron pins (RRSt 1403) is 17.5 mg. The entire surface of the pins amounts in each case to respectively about 100 $cm^2$. The corrosive effect on the plain iron thus is considerable. In contrast thereto, if 28 mg. of sodium hydroxide solution is dissolved in the liquid volume, the above-described experiment leads merely to the transfer of 0.35 mg. of iron into the solution. This value can be furthermore considerably reduced by adding to the liquid volume 0.15 ml. of a 25% aqueous ammonia solution instead of the sodium hydroxide solution. The thusdissolved amount of iron is, in this case, less than 0.05 mg. Consequently, corrosion is reduced by a factor of at least 35.

Comparative experiments led to the result that the corrosive effect is obviously greatly promoted by the presence of hydrogen sulfide since, when pure gaseous carbon monoxide is passed through pure methanol as well as through methanol combined with 10% water, only very minor amounts of iron pass into the solution.

Also the corrosion-inhibiting effect of the amines can be demonstrated in a similarly simple way. If a gaseous mixture consisting of 57 vol-% carbon monoxide, 29 vol-% hydrogen, 10.5 vol-% carbon dioxide, 3 vol-% nitrogen, 0.5 vol-% hydrogen sulfide is passed at 20° C. in a total quantity of 140 N1. through 20 ml. of a liquid volume consisting of 25% water and 75% methanol, then merely 2.2 mg. of iron is measured in the solution, even with the use of plain steel and with the addition of 10 mg. of monoethylamine, whereas with the addition of 100 mg. of monoethylamine, no measurable corrosion occurs any longer. Also triethylamine shows a strongly corrosion-inhibiting effect: with the addition of 73 mg. of triethylamine, the amount of dissolved iron is now only 0.04 mg.

However, the process of this invention is not only applicable to methanol scrubbing of gaseous mixture containing sour gases, or the drying thereof by means of an alcohol washing step, but is suitable quite generally for processes for the treatment of such gaseous mixtures with organic solvents, wherein the prevention of corrosion, as well as the requirement for a reduction in capital outlay play a part. Additional organic solvents worth mentioning, in this connection, are, for example, ethanol, acetone, N-methylpyrrolidone, and the dimethyl ether of polyethylene glycol.

The addition of alkaline-reacting compounds according to this invention has, apart from the corrosion-preventive effect, still another effect which likewise makes it possible to lower the investment costs, just as the suppression of the corrosion. Thus further effect occurs in scrubbing processes and resides in a considerable increase of the scrubbing capacity of the organic scrubbing fluid, this, in turn, providing the possibility of correspondingly reducing the dimensions of the scrubbing and regenerating devices.

Figure 2:
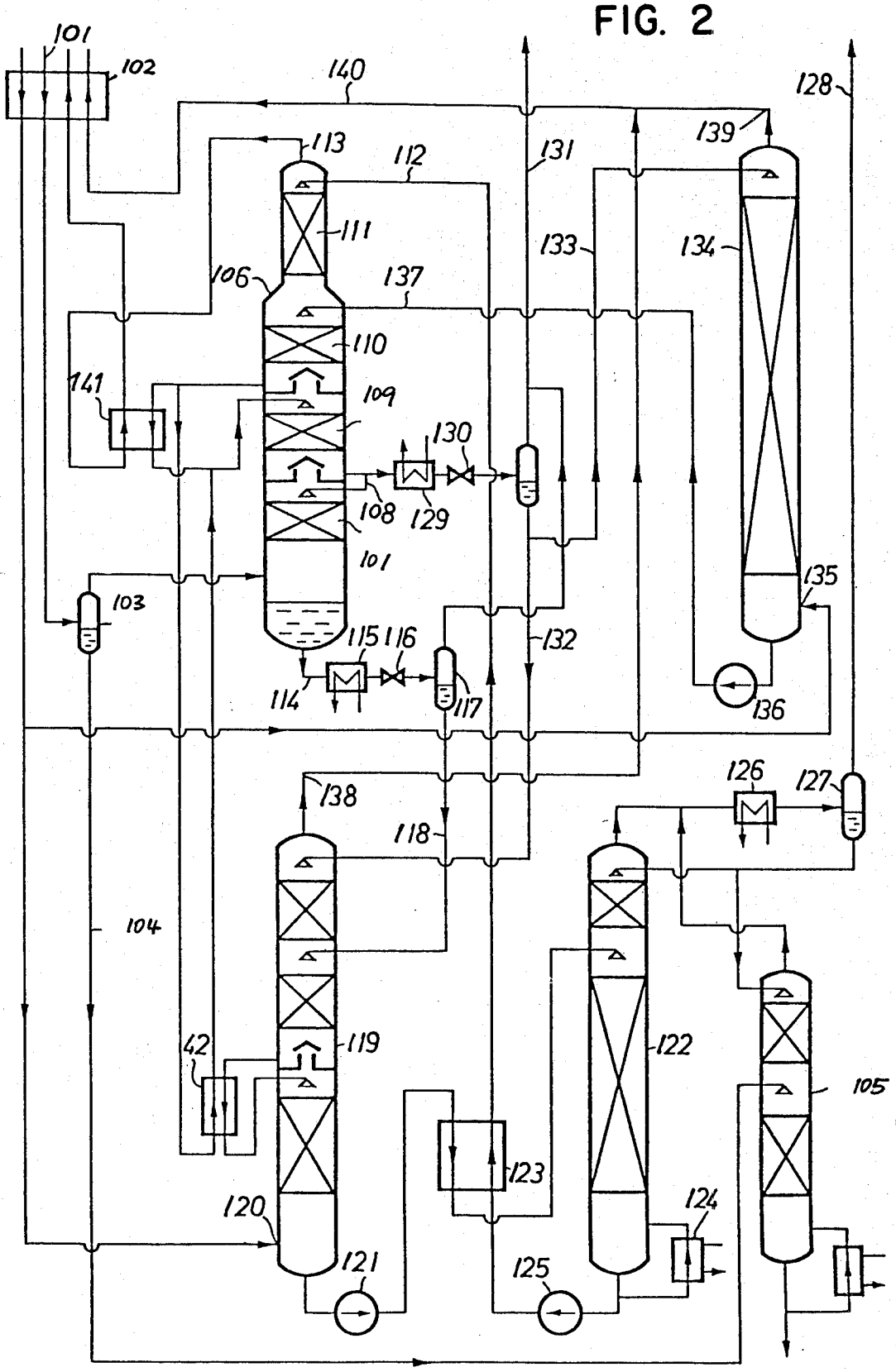
FIG. 2 is a more comprehensive schematic drawing of a preferred embodiment of the invention wherein the feed gas contains carbon oxides and hydrogen sulfide, and wherein the scrubber contains sections for drawing off fractions of scrubbing liquid rich in certain components.

This additional effect of the measure of this invention will be described hereinbelow with reference to a process example concerning the methanol scrubbing of gaseous mixtures containing carbon oxides and hydrogen sulfide, which example is depicted in FIG. 2. 154,000 $Nm^3/h$. of a gaseous mixture stemming, for example, from a coal gasification or oil gasification plant with a subsequent carbon monoxide conversion stage and containing, in addition to hydrogen and carbon monoxide, 35 vol-% carbon dioxide and 0.5 vol-% hydrogen sulfide is introduced under a pressure of 35 bar via a conduit 101 to the heat exchanger 102 and cooled therein to about −16° C. countercurrently to separation products. If the gaseous mixture contains water vapor, methanol is introduced even prior to entrance into the heat exchanger 102, in order to avoid icing during the cooling step. The condensed-out methanol-water mixture is separated in a separator 103 from the gaseous mixture and conducted via a conduit 104 to a methanol-water separating column 105.

The remaining gaseous mixture is introduced from the head of the separator 103 into the scrubbing column 106 wherein it is freed countercurrently to downwardly trickling methanol first of hydrogen sulfide and then of carbon dioxide. The hydrogen sulfide absorption takes place in the lowermost section 101 of the column, to which is fed carbon-dioxidesaturated methanol via a conduit 108. The main quantity of carbon dioxide is absorbed in sections 109 and 110 of the scrubbing column, whereas the final stage of the purification takes place in the uppermost section 111 to which is charged completely regenerated methanol via a conduit 112. From the head of the scrubbing column, 100,000 $Nm^3/h$. of pure gas is withdrawn via a conduit 113, which pure gas now contains at most 5 p.p.m. of carbon dioxide and at most 0.5 p.p.m. of hydrogen sulfide. The methanol loaded with carbon dioxide and hydrogen sulfide is withdrawn from the sump of the scrubbing column via a conduit 114. This methanol is introduced, after external cooling, for example with ammonia, in a cooler 115 and after expansion to about 8 bar in an expansion valve 116, into the separator 117 where the main portion of concomitantly dissolved hydrogen and carbon monoxide is degasified. From the separator 117 the loaded scrubbing methanol is conducted via a conduit 118 to a hydrogen sulfide enrichment column 119, operating at about 2 bar, where a large portion of the carbon dioxide is driven out by stripping with nitrogen fed at 120. The sump product of the enrichment column 119 has a temperature of about −67° C. and is conducted by means of a pump 121 into the regenerating column 122, which latter operates at about 3 bar. In a heat exchanger 123, this sump product is heated to about −60° C. countercurrently to regenerated methanol while the latter is being cooled. The hydrogen sulfide in the regenerating column is driven off by supplying heat at the sump of the column, for example by means of a steam heating unit 124. The completely regenerated methanol is returned from the sump of the regenerating column 122 by means of a pump 125 to the head of the scrubbing column 106. A gaseous fraction rich in hydrogen sulfide is withdrawn from the head of the regenerating column, from which any entrained methanol vapors are condensed out by external cooling in a cooler 126 and are separated in a separator 127. Via a conduit 128, 1,540 $Nm^3/h$. of a fraction rich in hydrogen sulfide is finally discharged; this fraction can be further processed, for example, in a Claus plant.

Heat is withdrawn from the carbon-dioxide-loaded, hydrogen-sulfide-rich scrubbing methanol, which is withdrawn underneath section 109 of scrubbing column 106, in a cooler 129 by means of external cold (for example ammonia). After expansion to about 8 bar in an expansion valve 130, any concomitantly dissolved proportions of hydrogen and carbon monoxide are degasified in a phase separator, which gaseous proportions are discharged together with the proportions degasified in separator 117 via a conduit 131.

The scrubbing methanol from separator 130, loaded with carbon dioxide, is introduced, in part, via a conduit 132 to the head of the hydrogen sulfide enrichment column 119 in order to recover by scrubbing any hydrogen sulfide stripped out together with the carbon dioxide, and, in part, fed via a conduit 133 to the head of the stripping column 134 where it is extensively freed of carbon dioxide by stripping with nitrogen introduced at 135. Thereafter, this latter portion is returned by means of a pump 136 via conduit 137 into the scrubbing column 106. The gaseous carbon dioxide fraction withdrawn from the head of stripping column 134 via conduit 139 is combined with the fraction withdrawn from the head of enrichment column 119 via conduit 138 and introduced via conduit 140 to the heat exchanger 102.

The heat of absorption liberated in scrubbing column 106 is removed, in part, in heat exchangers 141 and 42 and, in part, in coolers 115 and 129. In heat exchanger 141, pure gas from the head of the scrubbing column 106 is warmed against preloaded scrubbing methanol, while, in heat exchanger 14 heat of absorption and/or cold of desorption is transferred between a preloaded partial stream of scrubbing methanol stemming from the scrubbing column 106 and a partially stripped methanol stream stemming from the enrichment column 119.

If the process is conducted without the addition of alkaline-reacting compounds, then 200 tons/hour of methanol must be circulated in the methanol cycle leading via conduits 112, 118, and 132, the columns 106, 119, and 122, as well as pumps 121 and 125; and 100 t/h. of methanol must be circulated in the cycle comprising conduits 137 and 133 as well as pump 136. The external refrigeration to be supplied in order to compensate for the cold losses totals 1,884,000 kcal/h. In contrast thereto, if the circulated scrubbing methanol contains 0.1% by weight of ammonia, then pump 125 need merely circulate 100 t/h, while pump 136 must circulate 200 t/h. of methanol, and the amount of external cold to be supplied is now 1,414,700 kcal/h. In case of an ammonia content of 0.2% by weight, the corresponding values are 84 t/h. and 216 t/h. of methanol, respectively, as well as 1,391,000 kcal/h. It can be seen that, due to the addition of ammonia, the upper section 111 of scrubbing column 106 can be considerably reduced in size. Another reduction in expenses for the plant is obtained especially in the thermal regeneration and the hydrogen sulfide enrichment of the scrubbing methanol. Additionally, the requirement for external refrigeration is lowered.

What is claimed is:

1. A process for preventing corrosion caused by the formation of iron pentacarbonyls and sulfur-containing iron carbonyls, of apparatus made of iron or normal steel and occuring during the treatment of a gaseous mixture containing carbon monoxide and hydrogen sulfide with an aqueous alcoholic solution acting as a physical absorbent, comprising conducting the treatment in the presence of at least one alkaline-reacting inorganic compound selected from the group consisting of ammonia and sodium hydroxide thereby substantially preventing the formation of said iron pentacarbonyls and carbonyls.

2. A process according to claim 1, wherein the alkaline-reacting inorganic compound are added to the aqueous alcoholic solution, wherein the concentration of the alkaline-reacting inorganic compound in the aqueous alcoholic solution is maintained at values of between 5 and 200 mmol/l.

3. A process according to claim 1, wherein said alkaline-reacting inorganic compound is added in the gaseous phase to the gaseous mixture prior to the scrubbing step.

4. A process according to claim 1 for treating a moist gaseous mixture, wherein the scrubbing step is conducted below 0° C. and the liquid methanol is admixed, to avoid obstructions by ice formation, to the gaseous mixture prior to or during the preceding cooling step to the scrubbing temperature, said liquid methanol containing said alkaline-reacting compound.

5. A process according to claim 1, wherein ammonia is added as the alkalinereacting inorganic compound.

6. A process accrding to claim 1, wherein said treatment comprises scrubbing said gaseous mixture with liquid methanol containing said alkaline reacting inorganic compound.

7. A process according to claim 2, wherein said treatment comprises scrubbing said gaseous mixture with liquid methanol containing said alkaline reacting inorganic compound.

8. A process according to claim 5, wherein the ammonia is added to the gaseous mixture.

9. A process according to claim 2, wherein said concentration is between 30 and 60 mmol/liter.

10. A process according to claim 1, wherein said treatment comprises drying said gaseous mixture with a glycol.

11. A process according to claim 1, wherein the gaseous mixture contains 5 to about 90 molar percent of carbon monoxide.

* * * * *